United States Patent [19]

Jefferys

[11] 4,435,925

[45] Mar. 13, 1984

[54] SHIELD FOR EAVES DRAIN GUTTER

[76] Inventor: Henry J. Jefferys, P. O. Box 6029, Norfolk, Va. 23508

[21] Appl. No.: 955,862

[22] Filed: Oct. 30, 1978

Related U.S. Application Data

[63] Continuation-in-part of Ser. No. 668,324, Mar. 18, 1976, abandoned.

[51] Int. Cl.[3] ..... E04D 13/06

[52] U.S. Cl. ..... 52/12

[58] Field of Search ..... 61/45, 43; 52/11, 13, 52/12; 210/477

[56] References Cited

U.S. PATENT DOCUMENTS

| | | |
|---|---|---|
| 891,405 | 6/1908 | Cassens . |
| 2,669,950 | 2/1954 | Bartholomew . |
| 2,873,700 | 2/1959 | Heier . |

*Primary Examiner*—John E. Murtagh

*Attorney, Agent, or Firm*—Norman B. Rainer

[57] ABSTRACT

A shield is provided to prevent leaves, snow, ice and other solid debris from entering an eaves drain trough or gutter. The shield, which can be mounted above a conventional drain gutter, is of integral construction, and permits evaporation of stagnant water in the gutter.

8 Claims, 9 Drawing Figures

SHIELD FOR EAVES DRAIN GUTTER

RELATED APPLICATIONS

This application is a continuation-in-part application of application Ser. No. 668,324, filed Mar. 18, 1976 now abandoned.

BACKGROUND OF THE INVENTION

This invention relates to gutter or trough systems mounted on the eaves of buildings, and more particularly to improvements in such systems which will prevent leaves, snow, ice and other debris from entering and obstructing the gutter without impeding the normal flow of water from the roof into the gutter.

Most roof structures utilized on houses and other buildings are pitched or sloped to prevent the accumulation of water on the roof. In order to prevent the rain water which runs off a pitched roof from seeping into the foundation of the building, a gutter is generally mounted just under the terminal edge of the roof, known as the eaves, to catch the water and conduct it to a downspout which directs the water away from the building.

In the course of time, however, such gutters become clogged with leaves, twigs and other solid debris which are propelled into the gutter either by the action of the water running off the roof, or by the wind. When enough of such debris accumulates, it interferes with or eliminates the proper functioning of the gutter.

Several approaches have been earlier tried in an effort to solve this problem, but none have been completely successful. For example, U.S. Pat. Nos. 3,080,682; 3,295,264; 3,388,555 and 3,428,183 employ sieving means, generally positioned above the gutter, to separate the debris from the water before entrance into the gutter. One problem with this approach is that the screens or perforations utilized to achieve the sieving become obstructed themselves, and lose their functionality. Another problem is that a considerable quantity of fine material penetrates the sieve to enter and accumulate in the gutter.

U.S. Pat. No. 2,669,950 to Bartholomew utilizes a sharply curved promontory or nose, positioned below the eaves and above a trough, to provide a path for conducting water from a roof into the trough. Large solid objects are unable to travel around the curved nose, and consequently fall to the ground instead of entering the trough. Although this approach has merit, it does not prevent debris from entering the trough by the action of the wind. In fact, leaves which may deposit on the underside of the curved nose are in close proximity to the trough and in a very favorable position for being blown into the trough by the wind.

U.S. Pat. No. 2,873,700 to Heier also utilizes the aforesaid curved nose feature to separate the water from the debris, and endeavors further to avoid the problem of the accessability of the trough to wind-propelled debris. Said latter objective is accomplished in the Heier patent by provision of a totally enclosed trough which opens to permit entrance of water by means of a hinged gate or flap which is displaced to an open position in response to a flow of water. Although it may function when new and under ideal conditions, the flap loses its functionality when debris accumulates on it or within the trough. A more serious shortcoming of the trough of Heier is that the totally enclosed system is highly conducive to corrosive activity generally associated with stagnant air-water-metal systems. It is unlikely that such an enclosed system would enjoy long useful service before being destroyed by corrosion. Stagnant air-water environments, particularly at warm temperatures, also provide fertile conditions for the breeding of various microorganisms, some of which may be pathogenic to plants and/or humans, and some species of which may attack plastics which may be used in the construction of the trough or gutter, causing embrittlement thereof.

Still another deficiency of the enclosed trough of Heier is that visual inspection of the trough is impossible without removal from the building, and maintenance such as cleaning and painting is difficult even when the trough is removed from the building. It should be further noted that the Heier approach does not permit utilization of eaves gutters of standard design.

U.S. Pat. No. 891,405 to Cassens discloses an integral shield-trough combination utilizing a nose portion in the shield portion which does not project beyond the underlying trough. Below the nose portion is a small gutter structure containing horizontally elongated rectangular apertures spaced along the bottom thereof. Said apertures appear to occupy less than about 20% of the gutter structure and appear to be configured so that the ratio of height to width is about 0.5.

The apertures of the Cassens gutter are intended to permit passage of water while excluding debris such as leaves which survived travel around the nose portion. However, because both water and debris will travel codirectionally downward through said apertures, when the apertures become clogged with leaves, water cannot enter the apertures. There is no way the accumulated leaves are removed other than by periodic manual cleaning, which defeats the purpose of the shield-trough combination. It should also be noted that the Cassens apparatus requires a sharp fold at 3, which will alter metal crystal structure and hasten corrosion. Such corrosion will be further accentuated by the fact that the Cassens structure is almost completely enclosed in a manner such that water, accumulated in puddles or in debris within the trough cannot easily evaporate. The only evaporation may be through said apertures, which occupy only about 17% of the area of the gutter.

It is accordingly an object of the present invention to provide an eaves gutter provided with means for preventing entrance of debris into said gutter, whether said debris is propelled by wind, or water flowing off the roof. It is another object to provide a means for preventing entrance of debris into an eaves gutter, wherein said gutter is open to the air to permit visual inspection thereof and evaporation of stagnant water. It is a further object of the present invention to provide means for preventing entrance of debris into an eaves gutter, said means comprising no moving parts, permitting visual inspection of the trough, and being simple in construction and durable in operation. It is a still further object to provide means for preventing entrance of debris into an eaves gutter of conventional design whereby debris detained by said means may be blown away by natural currents of wind. Other objects and advantages will become apparent in the course of the following detailed description.

SUMMARY OF THE INVENTION

The objects of the present invention are accomplished in general by providing a shield of integral construction comprising a flat mounting portion, a downwardly angled collector portion to receive water from the roof of a building to which said shield is functionally attached, a curved nose portion positioned below said collector portion as an integral continuation thereof, a downwardly directed re-entrant portion emerging tangentially from the lower extreme of said nose portion, a leg portion pendant from said re-entrant portion and comprised of a multitude of teeth extending downwardly and adapted to engage with the forward lip of a below-mounted conventional drain trough, the spaces between said teeth representing at least 25% and preferably between 30% and 60% of the area of said leg portion, and a conductor surface beginning at the locus of origination of said leg portion along said re-entrant portion and extending inwardly in the general direction of said building. The outermost extreme of said nose portion extends beyond the forward lip of the below-mounted drain trough.

The spaces between said teeth are elongated in the vertical direction, having a length measured in their vertical direction more than 2.0 times the width of said spaces measured in the horizontal direction. In preferred embodiments the ratio of length to width of said spaces is between 3:1 and 9:1, and said teeth are curved in a vertical plane convexly or inwardly with respect to the interior of said drain trough and in a direction opposite to the curvature of said nose portion.

The upper surface of the shield, wherein it is intended to contact water, has a hydrophilic nature such that the contact or wetting angle of a drop of water on said surface is preferably less than 75°.

DETAILED DESCRIPTION OF THE INVENTION

Figure 1:
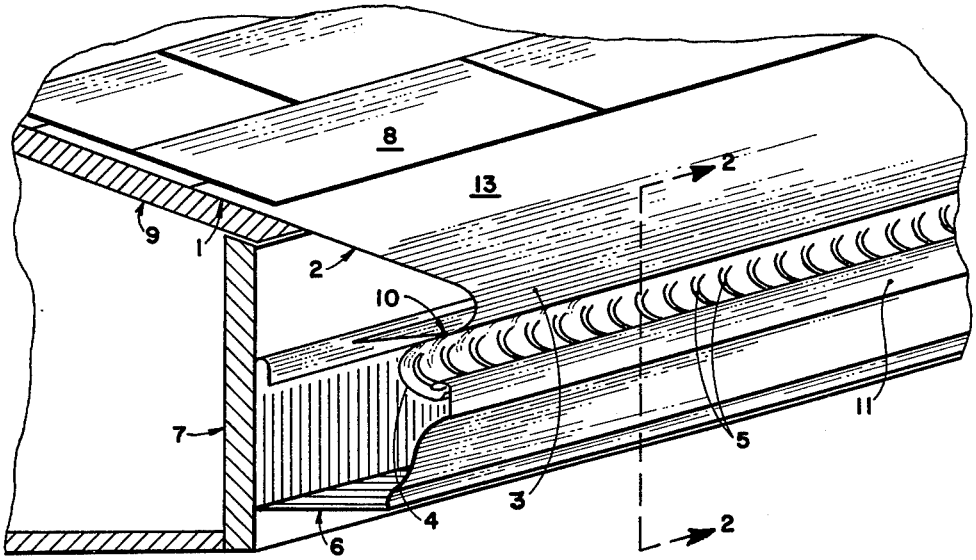
FIG. 1 is a perspective view showing an embodiment of the gutter shield of this invention mounted on the roof of a house in conjunction with an eaves gutter of standard construction.
Figure 2:
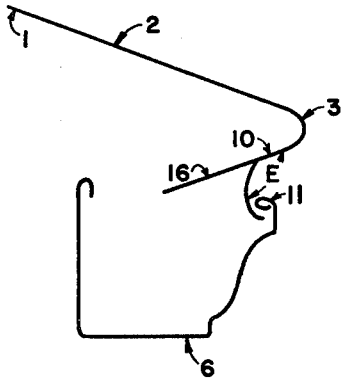
FIG. 2 is a sectional view of the shield and gutter of FIG. 1 taken along the line 2—2 of FIG. 1.

Referring to the accompanying drawings, FIG. 1 illustrates a gutter shield 13 mounted against the fascia 7 and under the shingles 8 of a building and positioned above a conventional eaves gutter trough 6. The shield comprises a flat mounting portion 1 which is nailed or otherwise fastened to the roof 9, and which leads into collector portion 2 terminating at the curved nose portion 3. A re-entrant portion 10 emerges tangentially from the nose portion and slopes downwardly in a direction opposite to the direction of slope of said collector portion. Pendant leg portion 4 is essentially an aligned assembly of identical teeth 12 which have been cut from the shield and folded downwardly at a sharp angle with respect to re-entrant portion 10. The value of said angle, represented as angle E in FIG. 2 is about 120°, but may range from about 80° to 140°. A conductor surface 16, which represents an extension of re-entrant portion 10, originates at the fold line 17 of pendant leg portion 4 and preferably angles downwardly, terminating at a location above the underlying trough 6. The function of conductor surface 16 is to receive water which travels around the nose portion and through the spaces 5 between teeth 12 of the pendant leg portion, and conduct said water into the trough. In this manner, the path of the water is essentially at right angles to any debris which survives nose 3 and travels downwardly along teeth 12.

The collector portion 2 begins at a location under the terminal extremity of the shingles of the roof and slopes downwardly toward the nose portion, where it constitutes an essentially tangential extension of the curve of said nose portion. The collector portion is preferably flat, although configurations having a slight convex or concave contour when viewed in their side sectional view are also contemplated as being within the purview of the present invention. A corrugated type surface may also be employed wherein the corrugations form small valleys or troughs running from the roof toward the nose portion 3 of the shield. The function of the collector portion is to receive water from the edge of the shingles, and direct the water, in the form of a continuous film or sheet to the curved nose portion.

The curved nose portion 3 is positioned in a manner such that its outermost extremity will project beyond leading edge 11 of eaves gutter 6 by at least ½ inch, and not more than about 1½ inches. The curve of the nose portion is preferably circular. However, curvilinear contours similar to circular configuration, such as parabolic, hyperbolic, eliptical, catenary, and the like may be employed, provided they closely conform to circular configuration at the outermost extremity of the nose portion. The radius of curvature of the nose portion, or the radius of a circle most closely conforming to its contour must be greater than about 0.5" and less than about 2".

The primary function of the nose portion 3 is to provide a supporting pathway to receive a flowing sheet of water from the collector portion 2 and direct said sheet of water to the reentrant portion 10. When properly contoured, the curved nose will cause the downwardly moving sheet of water to exert a siphoning effect wherein lower regions of the sheet exert a pulling or drawing force on the upstream region of the unbroken sheet of water. The siphon effect not only accelerates the flow of water but enhances its adherence to the hydrophilic surface of the shield. The principle whereby a flowing sheet of water adheres to a solid surface is known as the "Coanda Effect", and is more fully described in treatises on fluidic computers. When the radius of curvature of the nose portion is less than about 0.5", the sheet of water may break, thereby eliminating the siphon or Coanda effect and causing loss of adherence to the shield surface. In such instance, the water would fall directly to the ground, as though no eaves trough system were present. When the radius of curvature of the nose portion exceeds about 2", the path of the flowing sheet of water is no longer sufficiently tortuous to eject solid objects such as leaves.

Figure 4:
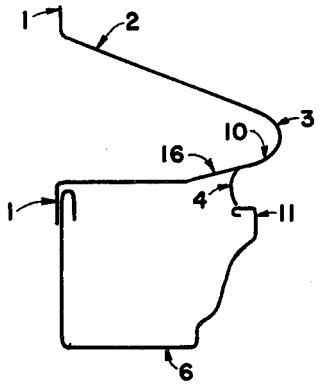

The re-entrant portion 10 originates as a tangential extension of the bottom extremity of the curved nose portion, and slopes downwardly and toward the fascia or the flat mounting portion 1 of the shield. The teeth 12 are supported at their upper extremity by the continuous uncut metal at the re-entrant portion of the shield. The conductor surface 16 in the embodiment of FIG. 4 extends back to the fascia where it provides a second mounting surface which imparts additional strength and stability to the shield.

Figure 6:
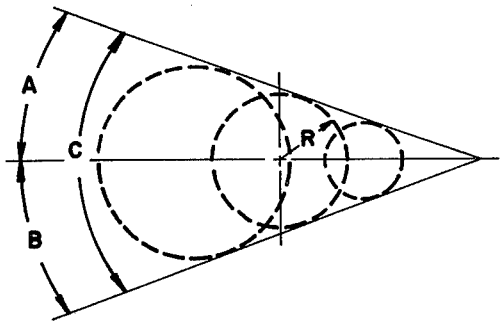
FIG. 6 illustrates the general angles and curves characteristic of a side sectional view of the shield.

In order for the shield of this invention to function properly in conveying water into an underlying gutter while rejecting leaves and other large solid debris, certain critical characteristics must be incorporated into the design. Referring to FIG. 6, angle C is defined by the intersection of the plane of the collector portion with the plane of the re-entrant portion, both of said planes being tangent to the curved nose portion. By drawing a horizontal line through the intersection of said planes, angles A and B are defined. Angle A corresponds to the angle of downward slope of the collector portion 2, and angle B corresponds to the angle of downward slope of re-entrant portion 10. As further shown in FIG. 6, a number of circles can be drawn within angle C tangent to the lines representing the sectional view of the intersecting planes, said circles representing the curvature of the nose portion and having radius R.

It has been found that best efficiency of operation of the gutter shield of this invention is obtained when angle A has a value between 20° and 70°, and B has a value between 15° and 45°. However, angle C, which is the sum of angles A and B, should not exceed 90°. Within this constraint on angles A, B and C, it has been found that the radius of curvature R of the nose portion can vary between 0.5" and 2.0", providing that the surface of the shield is sufficiently hydrophilic.

Figure 7:
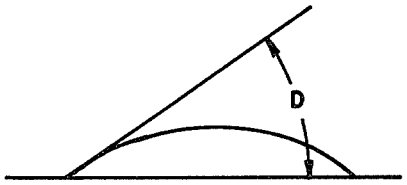
FIG. 7 illustrates the definition of the wetting or contact angle of a drop of liquid resting on a surface.

The hydrophilicity of the surface of the gutter shield may be measured by the contact or wetting angle D, as shown in FIG. 7, that a drop of water exhibits when resting on said surface. The surface of preferred embodiments of the shield will have a contact angle D between 1° and 75°, and more preferably between 5° and 45°. A detailed method for the measurement of the contact angle D may be found in Fort and Patterson, *J. Colliod Sci.* 18, 217(1963). Values of contact angles for various surfaces may be found in Shafrin and Zisman *J. Phys. Chem.* 64, 519 (1960).

The interrelationship between the several aforementioned critical parameters has been found, for preferred embodiments, to be definable by the equation:

$$22<(C/R)+D<250$$

wherein the units of C and D are degrees of angle, and R is expressed in inches. When the value of the equation is outside said limits, either the water will not maintain sufficient contact with the surface of the shield to be conveyed into the gutter, or the shield, although conveying water into the gutter will not adequately separate the water from the debris.

Figure 5:
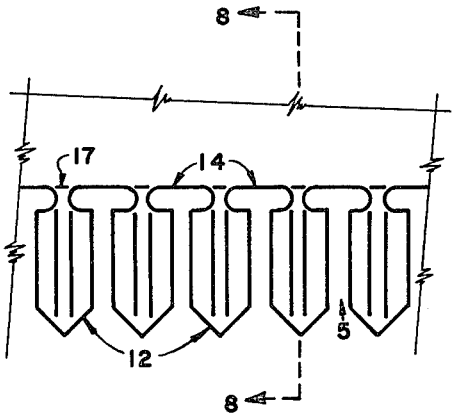
FIG. 5 is an enlarged fragmentary front view of the leg portion of the shield of FIG. 1.
Figure 8:
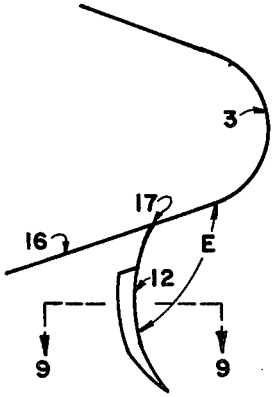
FIG. 8 is a sectional view taken along the line 8—8 of FIG. 5.
Figure 9:
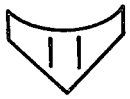
FIG. 9 is a sectional view taken along the line 9—9 of FIG. 8.

The leg portion 4 of the gutter shield is pendant from the re-entrant portion and originates as an abrupt change or discontinuity in the direction of said re-entrant portion. The preferred means for achieving the discontinuity is to provide a fold or crease 17 in the shield at the locus of origination of the leg portion, said crease 17 running the length of said shield. The teeth 12 which comprise said leg portion extend toward the front upper edge 11 of the drain gutter, and in some embodiments may contact the top of said edge or hook underneath said edge and thereby add structional support to the combined system. The teeth may be either flat or bowed slightly in the direction of the fascia as shown in FIGS. 8 and 9. The spaces 5 between teeth 12 begin at the crease line 17 from which the teeth originate. The size and configuration of the spaces 5 should be such as to permit visual observation of the interior of the gutter and also to facilitate evaporation of any water lying stagnant within the gutter. The spaces 5 between teeth 12 cumulatively represent at least 25% of the area of the leg portion. In preferred embodiments, said cumulative space will represent 30% to 60% of the area of said leg portion. A total space content of less than 25% of the area of the leg portion has been found to afford inadequate evaporation of water from within the drain trough. Space contents greater than 60% cause the teeth to lose effectiveness in filtering out the minor amount of debris that may survive passage around the nose portion. In preferred embodiments, the spaces have the form of elongated zones, as shown in FIG. 1. A particularly preferred configuration of the space 5 between teeth 12 is shown in FIG. 5 wherein horizontally disposed apertures 14 adjacent fold line 17 communicate with the upper region of spaces 5. This innovation provides for a greater rate of flow of water through apertures 14 and onto conductor surface 16.

The function of leg portion 4 is to prevent leaves or other debris propelled by either wind or water from entering the gutter while enabling water, delivered from the nose portion to pass transversely between the teeth 12 that constitute said leg portion. In a preferred type of tooth construction, as shown in FIGS. 8 and 9, the side extremities of the teeth are inwardly turned so as to minimize frictional engagement with debris and to facilitate the removal of said debris by natural air currents. Unlike slotted or perforated sieve means of the prior art which perform the primary separation of leaves from water, and rapidly become clogged, the leg portion of the gutter shield of this invention merely scavenges isolated leaves and other debris, thereby affording a measure of insurance that the shield will properly protect the gutter. It is also important to note that the generally vertical position of the leg portion is such that debris which might lodge there will be blown away by the action of the wind. The teeth of the leg portion are also protected from mechanical damage by virtue of their recessed location under the shield structure.

Surfaces of suitable hydrophilicity for use in the gutter shield may be produced by proper selection of base material and/or coating agents. In general, coatings comprised of hydrophilic polymers may be utilized. Suitable polymers can be characterized in possessing polar, oxygen-containing groups such as hydroxyl, carboxyl, carbonyl, amine and the like. Thus, coatings may be utilized comprising polymers such as polyvinyl acetate, polyacrylic acid, polyurethanes, polyepoxides, and still other filmforming polar polymers. The polymers may also be made to incorporate fine-dimensioned hydrophilic particles such as silica and clays. The coatings may be applied by conventional methods such as spraying, dipping or brushing of liquid coating agents, or thermal sintering of powder-based dry coatings.

Figure 3:
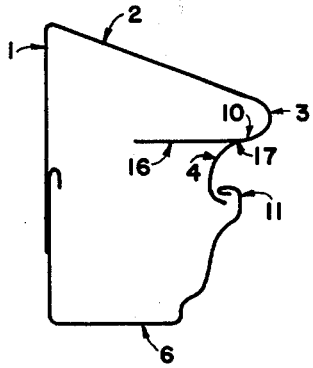
FIGS. 3 and 4 are side sectional views of other embodiments of shields with associated gutters.

The preferred base material is metal such as galvanized iron or aluminum. The gutter shield is preferably formed by roll-forming a single flat piece of suitable sheet metal stock which already contains a suitable hydrophilic surface. It may therefore be said that the shield is of an integral or monolithic construction. The gutter shield can be installed onto a building by nailing or otherwise fastening the mounting portion to the roof, as in the case with the embodiment of FIGS. 1 and 2, or fastening to the fascia as in the case of the embodiments of FIGS. 3 and 4. It is conceivable that the shield-gutter combinations shown in FIGS. 1, 3 and 4 may be fabricated as single, integral units.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described the invention, what is claimed is:

1. A gutter shield of integral construction adapted to be mounted under the eaves of a building and above a conventional drain gutter comprising a flat mounting portion, a downwardly sloped collector portion which tangentially merges with a curved nose portion, a re-entrant portion emerging tangentially from below said nose portion as a continuation thereof and downwardly sloped in a direction substantially opposite to the direction of slope of said collector portion, a leg portion pendant from said re-entrant portion as a continuation thereof and comprised of a multitude of uniformly spaced parallel teeth extending downward and terminating adjacent the outer lip of said drain gutter, the spaces between said teeth having a length to width ratio between 3:1 and 9:1 and the area of said spaces comprising between 30% and 60% of the total area of said leg portion, said teeth originating at a sharply defined angle of between 90° and 140° with respect to said re-entrant portion, and a conductor surface beginning at the locus of origination of said leg portion as a continuation of said re-entrant portion and extending inwardly in the general direction of said mounting portion, the outermost extremity of said nose portion projecting $\frac{1}{2}''$ to $1\frac{1}{2}''$ beyond said leg portion.

2. The gutter shield of claim 1 having a hydrophilic outer surface such that the contact angle of water with said surface is between about 1° and 75°.

3. The gutter shield of claim 1 wherein the radius of curvature of said curved nose portion is between about 0.5" and 2.0".

4. The gutter shield of claim 2 further defined by the relationship $$22<(C/R)+D<250$$

wherein C is the sum of the angles of slope of said collector portion and said re-entrant portion expressed in degrees of angle, R is the radius of curvature of said curved nose portion expressed in inches, and D is the contact angle of water with said hydrophilic outer surface, measured in degrees of angle.

5. A gutter shield in accordance with claim 1 wherein said spaces exist where said leg portion originates.

6. A gutter shield in accordance with claim 9 wherein the upper extremes of the spaces between said teeth communicate with spaces having a horizontally elongated configuration.

7. A gutter shield in accordance with claim 1 wherein said spaced parallel teeth have been derived from said conductor surface by a cutting and bending operation, the teeth having curvature in a vertical plane, said curvature being opposite in direction to the curvature of the nose, the side extremities of said teeth being angled in the direction of said mounting portion.

8. A gutter shield in accordance with claim 1 wherein the lowermost extremities of said teeth engage with the outer lip of said drain gutter.

* * * * *